United States Patent [19]

Tojo

[11] 4,102,362

[45] Jul. 25, 1978

[54] SHUTTLELESS LOOM

[75] Inventor: Akio Tojo, Higashi-murayama, Japan

[73] Assignee: Nissan Motor Company, Ltd., Japan

[21] Appl. No.: 745,222

[22] Filed: Nov. 26, 1976

[30] Foreign Application Priority Data

Aug. 10, 1976 [JP] Japan ..... 51-94489

[51] Int. Cl.[2] ..... D03D 47/34

[52] U.S. Cl. ..... 139/435; 226/91; 139/452

[58] Field of Search ..... 139/435, 452; 28/272; 226/7, 97, 91, 118

[56] References Cited

U.S. PATENT DOCUMENTS

| | | | |
|---|---|---|---|
| 3,465,939 | 9/1969 | Mullekom | 139/435 |
| 3,731,713 | 5/1973 | Lachapelle et al. | 139/452 |
| 3,970,231 | 2/1976 | Strutz et al. | 226/91 |
| 3,999,696 | 12/1976 | Reba et al. | 226/91 |

FOREIGN PATENT DOCUMENTS

| | | |
|---|---|---|
| 2,307,065 | 11/1976 | France. |
| 1,277,162 | 4/1969 | Fed. Rep. of Germany. |
| 461,401 | 10/1968 | Switzerland. |
| 1,130,504 | 10/1968 | United Kingdom. |

*Primary Examiner*—Henry S. Jaudon

*Attorney, Agent, or Firm*—Robert E. Burns; Emmanuel J. Lobato; Bruce L. Adams

[57] ABSTRACT

Air ejected from a nozzle past a yarn inlet of a detaining device creates a vacuum and inducts a weft yarn which is then carried by the stream of air to the yarn outlet.

7 Claims, 4 Drawing Figures

SHUTTLELESS LOOM

This invention relates to a shuttleless loom and more particularly to a device for detaining a predetermined length of a weft yarn before being shot into the shed of warp yarns.

A main object of the present invention is to provide an improved shuttleless loom which overcomes a problem encountered by prior art.

Another object of the present invention is to provide, in a shuttleless loom, an improved device for detaining a predetermined length of a weft yarn before being shot into the shed of warp yarns, the device being arranged such that the weft yarn can be easily threaded from a yarn inlet to a yarn outlet of the device without any troublesome manual operation.

A further object of the present invention invention is to provide, in a shuttleless loom, an improved device for detaining a predetermined length of a weft yarn before being shot into the shed of warp yarns, which device is equipped with air ejecting means for ejecting air from a portion adjacent a yarn, inlet of the device towards a yarn outlet of the device to easily thread the weft yarn from the yarn inlet into the yarn outlet.

Other objects, features and advantages of the present invention will be more apparent from the following description taken in conjunction with the accompanying drawings, in which.

Figure 1:
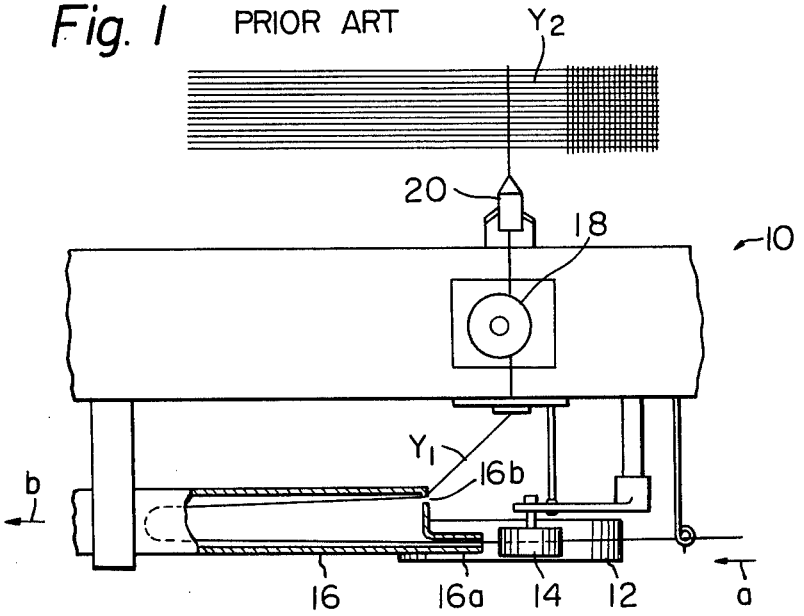
Fig. 1 PRIOR ART
FIG. 1 is a schematical plan view of the weft yarn operating device of a prior art shuttleless loom.

FIG. 1 illustrates the weft yarn operating device 10 of a prior art shuttleless loom of a fluid jet type. In the device 10, a weft yarn $Y_1$ is supplied from a yarn supply device (not shown) in the direction of an arrow *a* and fed between a rotatably supported measuring drum 12 and a pressing roller 14 which rotatably contacts the measuring drum 12 for pressing the fed yarn $Y_1$ on the peripheral surface of the measuring drum 12. The measuring drum 12 is adapted in combination with the pressing roller 14 to measure a required length of the yarn. The yarn drawn out of the drum 12 and the roller 14 is sucked into a detaining device 16 through its inlet pipe 16*a*. The detaining device 16 is arranged to detain thereinside a predetermined length of the yarn $Y_1$ in U-shape as shown in the drawing by the action of air flowing in the direction of an arrow *b* since the detaining device 16 is connected to an air induction or suction device (not shown) such as a blower at its one end opposite to the other end having the inlet pipe 16*a*. The yarn detained in the detaining device 16 is then drawn out therefrom through a yarn outlet aperture 16*b* of the device 16. Thereafter, the yarn $Y_1$ is introduced into a grasping device 18 for grasping a portion of the yarn to prepare a predetermined length of the yarn prior to be thrown through a nozzle 20. The nozzle 20 is arranged to throw or shoot the weft yarn with respect to the shed of warp yarns $Y_2$ with a fluid such a water or air ejected through the nozzle 20.

With the such arranged prior art device 10, in order to thread the weft yarn $Y_1$ from the inlet pipe 16*a* of the detaining device 16 through the interior thereof into the yarn outlet aperture 16*b* of the same before starting of the fluid jet shuttleless loom, an operator at first starts the blower to suck the yarn $Y_1$ through the inlet pipe 16*a* into the interior of the detaining device 16 by the action of the suction air flowing in the direction of the arrow *b* and thereafter stops the blower. The operator, then, inserts through the yarn outlet aperture 16*b* a tool having its one end a hook and hooks the yarn $Y_1$ residing in the detaining device 16 to draw the yarn $Y_1$ out of the detaining device 16 through the yarn outlet aperture 16*b*. However, this operation of threading the yarn $Y_1$ from the inlet pipe 16*a* to the yarn outlet aperture 16*b* of the detaining device 16 is rather difficult even for an expert in such an operation and accordingly a considerable time and a skill are required for the above-mentioned manual threading operation of the weft yarn.

This invention, therefore, contemplates to eliminate the above-described problem encountered by the prior art and improve the inefficient manual threading operation of the weft yarn by installing in the detaining device means for ejecting air from an interior portion of the detaining device adjacent the inlet pipe for the weft yarn towards the yarn outlet aperature in order to thread the weft yarn from the inlet pipe into the yarn outlet aperture.

Figure 2:
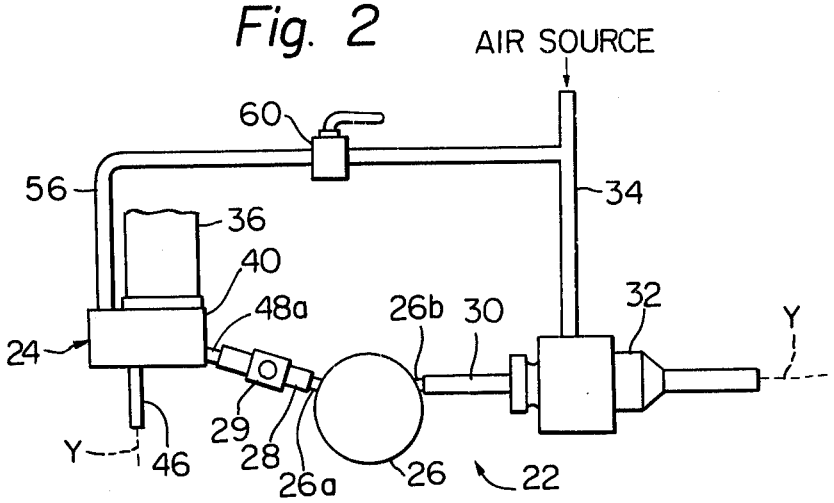
FIG. 2 is a schematical view of the weft yarn operating device incorporated with a detaining device according to the present invention.

Referring now to FIG. 2, there is shown an example of a weft yarn operating device 22 of a shuttleless loom of a fluid jet type, having incorporated therein a detaining device 24 or detaining means in accordance with the present invention. The construction and the operation of the detaining device 24 will be explained in detail hereinafter. In the weft yarn operating device 22, a weft yarn Y drawn out of the detaining device 24 is introduced into a grasping device 26 through a pipe 28 connected to an inlet 26*a* formed with the casing of the grasping device 26. Disposed slidably and rotatably around the pipe 28 is a controlling member 29 which is explained in detail later. The grasping device 26 is adapted to grasp a portion of the yarn Y in preparation for the next step. An outlet 26*b* of the grasping device 26 is connected through a pipe 30 to a nozzle 32 for throwing or shooting the weft yarn Y with air ejected or jetted through the nozzle 32 in a desired direction. The air is fed under pressure through an air feeding pipe 34 connecting the nozzle 32 and an air source for supplying air under pressure.

Figure 3:
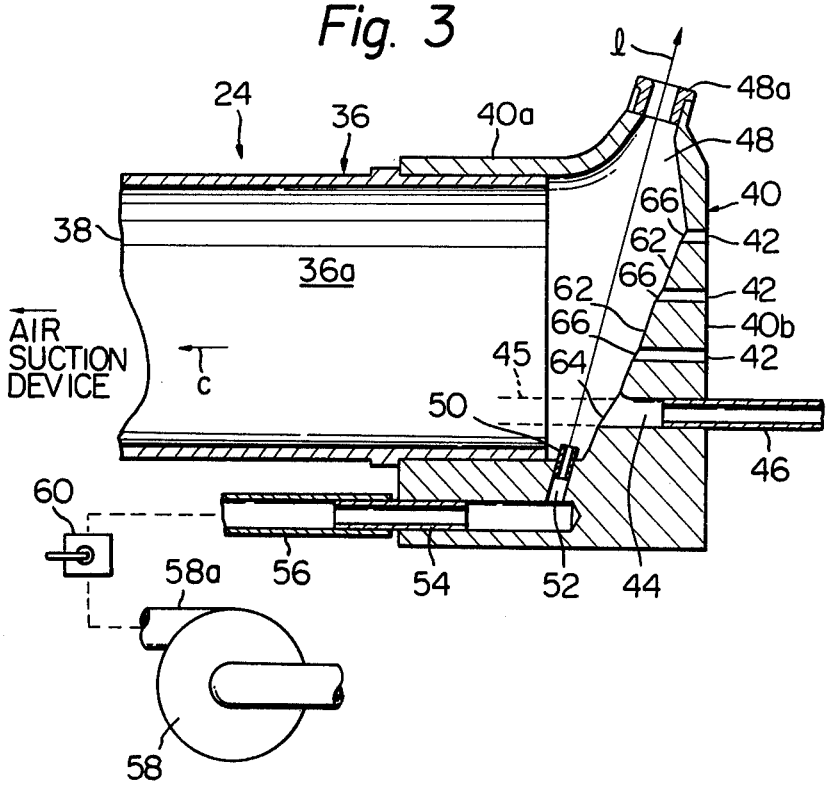
FIG. 3 is a vertical section view of the detaining device of FIG. 2.

The detaining device 24 is illustrated in detail in FIG. 3, in which the device 24 is composed of a hollow flat elongate body 36 which defines therein an elongate chamber 36*a* and has a first end portion 38 communicated with an air suction device or means for drawing in air such as a blower, and a second end portion 40 opposite to the first end portion. The lid shaped second end portion 40 includes a sleeve 40*a* secured to the outer surface of the body 36. The one end formed by the sleeve 40*a* is closed by a closing end wall integral with the sleeve 40*a*. The closing end wall 40*b* is formed with a plurality of through holes or elongate bore 42 for communicating the elongate chamber 36*a* and the outside of the body 36. The holes 42 are arranged parallel to the longitudinal axis (not shown) of the hollow elongate body 36. Additionally, the closing wall 40*b* is formed with an inlet bore 44 through which the weft yarn is introduced into the elongate chamber 36*a*. The inlet bore 44 is also arranged parallel to the longitudinal axis of the body 36. Shown by dotted lines 45 is an imaginary extension of the inlet bore 44. The reference numeral 46 indicates a yarn inlet pipe secured to the inner surface of the inlet bore 44. An outlet opening 48 or a yarn outlet aperture is formed through the sleeve 40*a* of the second end portion 40. The outlet opening 48 is followed by an outlet tube 48*a* which is connected to the pipe 28.

Disposed through the sleeve 40*a* of the second end portion 40 and projected into the chamber 36*a* is an air ejecting nozzle member 50 forming part of air ejecting means (no numeral) for ejecting air from a portion of the wall of the second end portion adjacent the inlet bore 44 through the elongate chamber 36*a* towards the outlet opening 48. The air ejection nozzle 50 is inserted into an elongate bore 52 formed in the sleeve 40*a* to be directed such that its longitudinal axis (not identified) lies on a line l connecting the extension of the longitudinal axis (not identified) of the inlet bore 44 and the center of the outlet opening 48 as clearly shown in the drawing. The elongate bore 52 is communicated through pipes 54 and 56 with the discharge pipe 58*a* of a blower 58 or the air source for supply air under pressure to the opening 52. The reference numeral 60 indicates a valve for closing or opening the pipe 56.

It is to be noted that the air ejecting nozzle member 50 is located farther from the outer surface of the closing wall 40*b* than the outlet opening 48 as shown in the drawing and accordingly the air is ejected in the direction indicated by the line l which is inclined with respect to the longitudinal axis of the body 36. With this connection, the inner surface of the closing end wall 40*b* of the second end portion 40 is formed as shown in the drawing in which surfaces 62 are inclined with respect to the longitudinal axis of the body 36 in order to smoothly guide air ejected from the nozzle member 50 towards the outlet opening 48. Furthermore, the surfaces 64 and 66, of the inlet bore 44 and the elongate bores 42 defined at the inner surfaces of closed end wall 40*b* are formed to have an inclination smaller, with respect to the longitudinal axis of the body 36, than the surfaces 62.

With the thus arranged detaining device 24, in order to thread the weft yarn Y from the yarn inlet pipe 46 and the inlet bore 44 into the outlet opening 48, air is at first ejected from the air ejecting nozzle in the direction indicated by the line l by opening the valve 60. Then, the air flows along the surfaces 62 formed at the inner surface of the closing end wall 40*b*. Thus a vacuum is generated at a portion adjacent the surface 64 in which the inlet bore 44 is formed since the surface 64 is slightly sunk below the stream of the air flowing towards the outlet opening 48. By the action of the vacuum generated, the weft yarn is sucked and drawn in the elongate chamber 36*a* through the yarn inlet pipe 46 and the inlet opening 44. Thereafter, the yarn drawn into the chamber 36*a* is carried towards the outlet opening 48 by the stream of the flowing air ejected from the nozzle 50. It will be understood that the yarn carried by the air stream does not rush out of the chamber 36*a* through the elongate bores 42 since a vacuum is generated adjacent the surface 66 of the elongate bores 42 by the same reason as in the inlet bore 44 and therefore air flows through the elongate openings 42 from the outside of the closing end wall 40*b* into the elongate chamber 36*b*. Accordingly, the weft yarn drawn in from the inlet opening 44 is smoothly guided and carried to the outlet opening 48. Thus, the threading operation of the weft yarn from the inlet bore 44 to the outlet opening 48 of the detaining device 24 is smoothly and easily completed and thereafter the yarn drawn out of the chamber 36*a* from the outlet opening 48 is introduced through the outlet tube 48*a* into the pipe 28 leading to the grasping device 26 mentioned before. In this state, when the air suction device such as a blower connected to the first end portion of the hollow elongate body 36 is started, air is sucked and drawn through the bores 42 formed through the closing end wall 40*b* into the elongate chamber 36*a* and flows in the direction indicated by an arrow *c* and accordingly a predetermined length of the weft yarn is detained in the elongate chamber 36*a* in the same manner as in the prior art detaining device 16 shown in FIG. 1.

Figure 4:
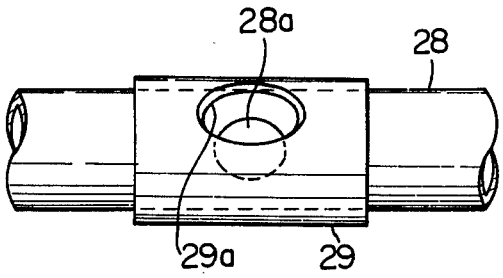
FIG. 4 is a perspective view of a device for controlling air drawn into the detaining device of FIG. 2.

FIG. 4 shows in detail the arrangement of the pipe 28 connecting the detaining device 24 and the grasping device 26 and the controlling member 29 which is slidably and rotatably disposed around the pipe 28. As seen, the cylindrical controlling member 29 is slidably and rotatably disposed on the peripheral surface of the pipe 28 and is formed with a circular opening 29*a* which is agreeable with a circular opening 28*a* formed through the wall of the pipe 28. With this arrangement, during the threading operation of the weft yarn Y from the inlet bore 44 into the outlet opening 48 of the detaining device 24, the cylindrical controlling member 29 is located to close the opening defined by cooperation of the opening 29*a* of the controlling member 29 and the opening 28*a* of the pipe 28. However, after the operation of the shuttleless loom is started, the controlling member 29 is rotated at a position to fully open the opening defined by the opening 29*a* of the controlling member 29 and the opening 28*a* of the pipe 28 in order to allow air to enter the elongate chamber 36*b* of the body 36, whereby the weft yarn thrown from the nozzle 32 is not affected by the suction force generated in the elongate chamber 36*a* of the hollow elongate body 36 of the detaining device 24.

While only air has been shown and described to be ejected through the nozzle 32 to throw the weft yarn in a desired direction, it will be understood that the air may be replaced with water. Additionally, it will be understood that this invention may be applied to shuttleless looms other than the fluid jet type shown and described hereinbefore.

What is claimed is:

1. A shuttleless loom having yarn throwing means for throwing a weft yarn with respect to a shed of warp yarns, and detaining means for detaining a predetermined length of the weft yarn in air flowing therethrough before the weft yarn is supplied to the yarn throwing means, said detaining means comprising;

a hollow elongate body defining therein an elongate chamber through which air is inductable, said hollow elongate body having a first end portion communicating in use with means for inducting air, and a second end portion opposite to said first end portion, said second end portion having an inlet bore providing communication between the elongate chamber and the outside of said hollow elongate body for introducing the weft yarn into the elongate chamber, and an outlet opening providing communication between the elongate chamber and the outside of said hollow elongate body for drawing out the weft yarn from the elongate chamber;

the second end portion of said hollow elongate body including a sleeve and a closing end wall closing an end formed by the sleeve, said closing end wall having a plurality of elongate bores providing communication between the elongate chamber and the outside of said hollow elongate body and arranged parallel to the longitudinal axis of said hollow elongate body to induct air therethrough into the elongate chamber, the inlet bore extending through said closing end wall;

air ejecting means for ejecting air from a portion of said second end portion adjacent said inlet opening through the elongate chamber towards the inlet opening, and said air ejecting means including an air ejecting nozzle member in the sleeve of the second end portion of said hollow elongate body and projecting into the elongate chamber.

2. A shuttleless loom as claimed in claim 1, in which the longitudinal axis of the inlet bore is parallel to the longitudinal axis of said hollow elongate body.

3. A shuttleless loom as claimed in claim 1, in which said air ejecting nozzle member is located farther from the outer surface of said closing end wall than the outlet opening.

4. A shuttleless loom as claimed in claim 3, in which said closing end wall has an inner surface inclined with respect to the longitudinal axis of said hollow elongate body.

5. A shuttleless loom as claimed in claim 4, in which a surface in which said inlet bore is formed has an inclination smaller with respect to the longitudinal axis of said hollow elongate body, than that of said inner surface of said closed end wall.

6. A shuttleless loom as claimed in claim 5, in which the surface in which is formed each elongate bore for inducting air therethrough has an inclination smaller with respect to the longitudinal axis of said hollow elongate body than that of said inner surface of said closing end wall.

7. A shuttleless loom as claimed in claim 1, in which said air ejecting nozzle member is directed so that its longitudinal axis lies on a line connecting the extension of said inlet bore and said outlet opening.

* * * * *